US008393623B2

(12) United States Patent
Storer

(10) Patent No.: US 8,393,623 B2
(45) Date of Patent: Mar. 12, 2013

(54) MECHANICAL PUZZLE WITH HINGE ELEMENTS, ROPE ELEMENTS, AND KNOT ELEMENTS

(76) Inventor: James Andrew Storer, Lincoln, MA (US)

( * ) Notice: Subject to any disclaimer, the term of this patent is extended or adjusted under 35 U.S.C. 154(b) by 513 days.

(21) Appl. No.: 12/589,812

(22) Filed: Oct. 29, 2009

(65) Prior Publication Data

US 2011/0101609 A1 May 5, 2011

(51) Int. Cl.
*A63F 9/06* (2006.01)

(52) U.S. Cl. ..... 273/156; 273/159

(58) Field of Classification Search ..... 273/157 R, 273/156, 153 S, 159; 446/119, 109, 111
See application file for complete search history.

(56) References Cited

U.S. PATENT DOCUMENTS

| | | | | | |
|---|---|---|---|---|---|
| 430,502 | A | | 6/1890 | Altekruse | |
| 1,251,400 | A | * | 12/1917 | Mees | 273/153 S |
| 2,825,178 | A | * | 3/1958 | Hawkins | 446/119 |
| 2,877,506 | A | * | 3/1959 | Almoslino | 273/155 |
| 3,201,894 | A | * | 8/1965 | Resch | 273/155 |
| 3,222,072 | A | * | 12/1965 | Dreyer | 273/157 R |
| 3,496,670 | A | * | 2/1970 | Ryan et al. | 446/124 |
| 3,550,310 | A | * | 12/1970 | Bock-Greissau | 446/85 |
| 3,561,757 | A | * | 2/1971 | Schillig | 446/104 |
| 3,577,673 | A | * | 5/1971 | Monestier | 446/490 |
| 3,596,396 | A | * | 8/1971 | Thomson | 446/487 |
| 3,628,261 | A | * | 12/1971 | Thompson | 273/155 |
| 3,655,201 | A | | 4/1972 | Nichols | |
| 4,378,116 | A | | 3/1983 | Rubik | |
| 4,418,915 | A | * | 12/1983 | Calebs | 273/159 |
| 4,633,607 | A | * | 1/1987 | Brasch et al. | 446/487 |
| 4,722,712 | A | * | 2/1988 | McKenna | 273/155 |
| 4,784,392 | A | | 11/1988 | Johnson et al. | |
| 4,844,466 | A | | 7/1989 | Johnson et al. | |
| 4,875,681 | A | * | 10/1989 | Ofir | 273/155 |
| 5,108,100 | A | * | 4/1992 | Essebaggers et al. | 273/153 R |
| 5,152,530 | A | * | 10/1992 | Dodek, II | 273/156 |
| 5,192,077 | A | * | 3/1993 | Caicedo | 273/155 |
| 5,302,148 | A | * | 4/1994 | Heinz | 446/119 |
| 5,538,452 | A | * | 7/1996 | Kurani | 446/109 |
| 6,161,832 | A | * | 12/2000 | Holahan et al. | 273/153 S |
| 6,241,248 | B1 | | 6/2001 | Winter | |
| 6,460,850 | B1 | * | 10/2002 | Dodek, II | 273/156 |
| 6,467,205 | B1 | * | 10/2002 | Flagg et al. | 273/157 R |
| 6,712,358 | B1 | * | 3/2004 | Dimitriou et al. | 273/157 R |
| 2010/0230897 | A1 | * | 9/2010 | Stott | 273/153 S |

* cited by examiner

*Primary Examiner* — Steven Wong

(57) ABSTRACT

In one embodiment of the present invention, cubes with beveled edges that are joined by hinge elements can be folded into a larger cube. In another embodiment, a puzzle object with a plurality of holes may have a rope element threaded through it so as to conceal knot elements. In yet another embodiment, a plurality of puzzle objects with holes that are joined by hinge elements may have a rope element threaded through tunnels formed by the holes so as to conceal the knot elements. Different aspects and further embodiments of this invention provide for puzzles and amusements of varying design.

8 Claims, 13 Drawing Sheets

MECHANICAL PUZZLE WITH HINGE ELEMENTS, ROPE ELEMENTS, AND KNOT ELEMENTS

CROSS-REFERENCE TO RELATED APPLICATIONS (Not Applicable)

STATEMENT REGARDING FEDERALLY SPONSORED RESEARCH OR DEVELOPMENT (Not Applicable)

REFERENCE TO A SEQUENCE LISTING, A TABLE, OR A COMPUTER PROGRAM LISTING COMPACT DISK APPENDIX (Not Applicable)

BACKGROUND OF THE INVENTION

The present invention relates to an apparatus or method for a puzzle or amusement based on an arrangement of puzzle objects with hinge elements and holes to accommodate rope elements that may have knot elements that must be concealed in tunnels formed by the holes; FIG. 1 depicts several embodiments.

FIG. 2 shows the classic "Fifteen Puzzle" (which became popular in the 1880's), where a goal is to slide the pieces to put the numbers in order. An advantage of the version shown in FIG. 2 is that whether solved or not, its pieces always remain together (via shapes attached to portions of the tiles that engage adjacent tiles and the frame); for example, the puzzle can be repeatedly picked up, manipulated (without necessarily solving it) and put down. We refer to puzzles with this property as having the connected property. A disadvantage of the Fifteen Puzzle is that it is so well known so as not to provide significant interest for many people at this point in time. It achieves the connected property in a different way than aspects of the present invention.

FIG. 3 shows the now famous "Rubik's Cube" (which became popular in the 1980's), described in U.S. Pat. No. 4,378,116 to Rubik, where a central assembly combined with shapes attached to portions of the pieces (left in FIG. 3) are used to keep the puzzle together in a 3×3×3 cube shape (right in FIG. 3) that can be manipulated to make each face a single color. The U.S. Pat. No. 3,655,201 to Nicholas describes a puzzle where groups of cube faces are joined with magnets for functionality like a 2×2×2 version of Rubik's Cube, as depicted in FIG. 4. Although Rubik's Cube and the puzzle of the Nicholas patent have the connected property, solving is too difficult for many people; both of these puzzles achieve the connected property in a different way than aspects of the present invention.

FIG. 5A depicts the pieces of the well-known "Soma Cube" (which became popular in the 1960's) that can be assembled in many ways into a 3×3×3 cube. Many variations of puzzles based on pieces of this type have since been made, of which the "Bedlam Cube" of FIG. 5B is an example (see also the U.S. Pat. Nos. 4,784,392 and 4,844,466, both to Johnson and Johnson); such puzzles have the disadvantage that when not solved, one is left with a collection of pieces (they not have the connected property). FIG. 5C shows on the left the pieces of the "Yamato Burr Puzzle" from the 1920's, where its pieces can be assembled into the shape shown on the right in FIG. 5C; numerous burr puzzles have been made for over a century (e.g., U.S. Pat. No. 430,502 to Altekruse), and they all have the same disadvantage as the Soma Cube of being left with multiple pieces when unsolved (that is, they also do not have the connected property). Many other approaches to puzzle design have the same disadvantage of not having the connected property (e.g., see the U.S. Pat. No. 6,241,248 to Winter that employs interlocking cubes).

FIG. 6A shows the well known "Rubik's Snake" (which became popular in the 1990's), where plastic pieces are joined so that faces can rotate against each other (left in FIG. 6A), and the puzzle can be manipulated into the diamond shape (right in FIG. 6A). Joining puzzle objects by faces that rotate with respect to each other is different than the method of joining with hinge elements that is an aspect of the present invention. "Kev's Cubes", described in the U.S. Pat. No. 3,222,072 to Dryer, is another example from the prior art of a puzzle that has the connected property; 27 cubes linked by an elastic cord (shown on the left in FIG. 6B) can be configured into a 3×3×3 cube (shown on the right in FIG. 6B). Like Rubik's Snake, Kev's Cubes joins cubes via faces rotating against each other, and again, is different than the method of joining with hinge elements that is an aspect of the present invention; it also has the disadvantage that the use of an elastic cord to connect the pieces makes for what can be a less than satisfying puzzle to manipulate and store, and it also suffers from the disadvantage of being prone to wearing out.

FIG. 7 shows the "Warhol Cube" puzzle from the prior art that has the connected property, where eight cubes are attached along certain edges via a flexible material so that they can be folded into a 2×2×2 cube. Also as shown in FIG. 7, this 2×2×2 cube can be unfolded in two different ways to form a 2×4×1 array, and then in both cases that 2×4×1 array can be folded lengthwise to form another 2×4×1 array. This puzzle is an amusement that is easy to manipulate, and with graphics on the surfaces so that when picked up it can be easily folded into the 2×2×2 cube and other arrangements to display different combinations of the graphics (Andy Warhol art). A disadvantage of this puzzle is that it may be less pleasant or interesting to use than puzzles designed according to aspects of the present invention, and also, the flexible connections can wear out.

BRIEF SUMMARY OF THE INVENTION

The present invention is directed to an apparatus where a number of puzzle objects are joined by hinge elements in a way that they can be folded up to form a desired arrangement. Joining puzzle objects with hinge elements is different from joining puzzle objects via adjacent faces (as with the Rubik's Snake and Kev's Cubes prior art), with engaging shapes attached to portions of puzzle objects (as with the Fifteen and Rubik's Cube prior art), or with magnetic attractions between groups of faces (as with the Nicholas patent prior art). Beveling of edges allows for interlocking hinge elements to be effectively employed to achieve a more pleasant to manipulate and more durable puzzle than the Warhol Cube prior art. In addition, holes may pass through the puzzle objects so that, in its folded state, a rope element may be passed through tunnels formed by the holes in such a way so as to conceal knot elements of the rope.

DETAILED DESCRIPTION OF THE INVENTION

Figure 8:
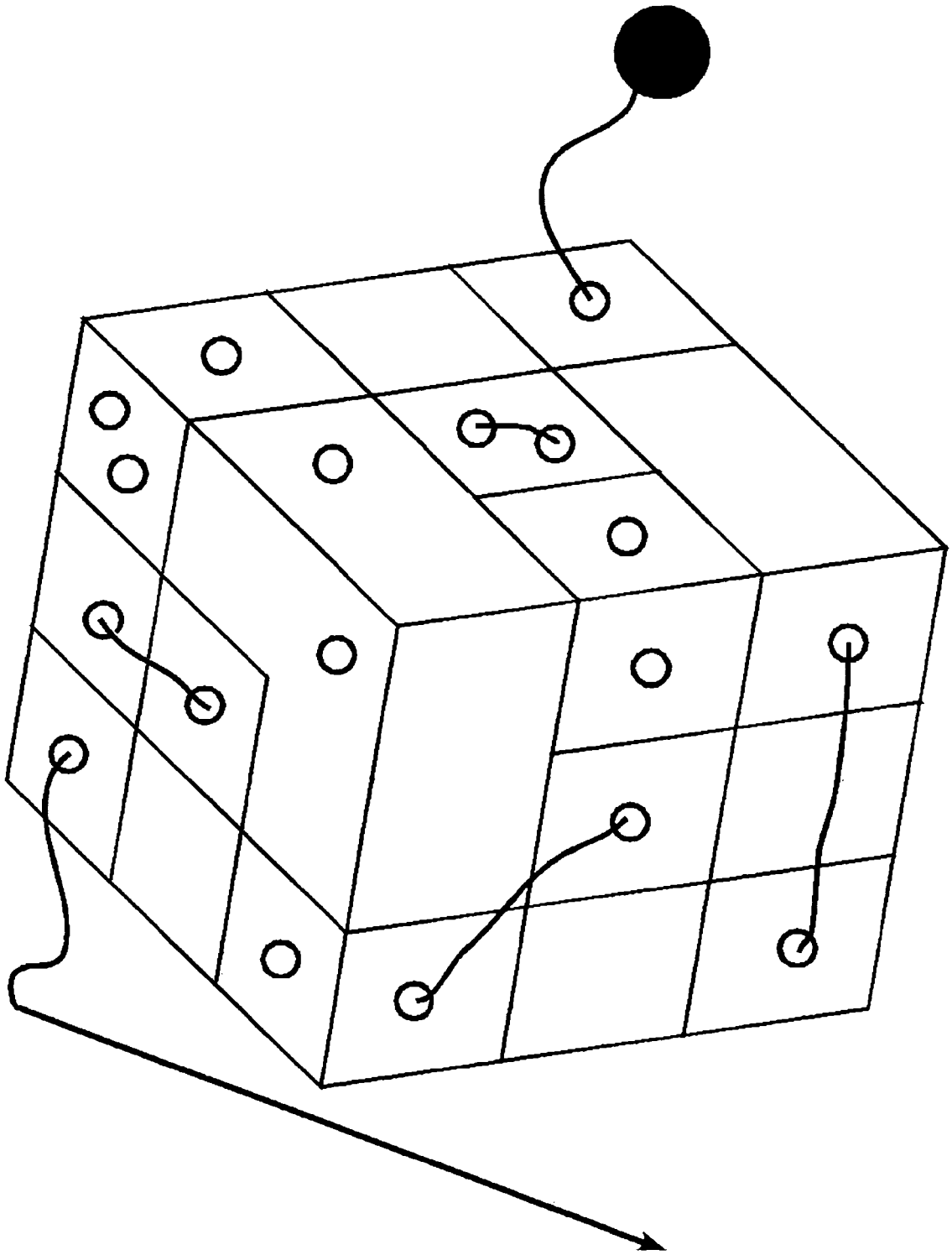
FIG. 8 depicts an embodiment of the present invention comprising an arrangement of 27 puzzle objects with holes and a rope element.

FIG. 8 depicts an embodiment of the present invention comprising 27 cubes in a 3×3×3 arrangement where holes in some of the cubes align to form tunnels that pass through the arrangement, through which a rope element may pass. Certain edges of these cubes can be joined with a hinge element (not shown in FIG. 8) so that the puzzle has the connected property. Joining puzzle objects with hinge elements is different from joining puzzle objects via adjacent faces (as with the Rubik's Snake and Kev's Cubes prior art), with engaging shapes attached to portions of puzzle objects (as with the Fifteen Puzzle and Rubik's Cube prior art), or with magnetic attractions between groups of faces (as with the Nicholas patent prior art). The inclusion of holes and one or more rope elements in a puzzle with hinge elements improves upon the Warhol puzzle prior art. Also, the rope element may have knot elements along it that are concealed in tunnels. In FIG. 8 the rope element is stiff on one end so as to make it easier to pass it through tunnels; rope elements may also have more than one stiff portion, or no stiff portions (e.g., FIG. 13A). In FIG. 8 the rope element is not attached to any cube and has a terminating ornament on it. In other embodiments of the present invention there is no terminating ornament on a rope element, or one end of a rope element is attached to the puzzle (e.g., FIG. 13A).

Figure 9A:
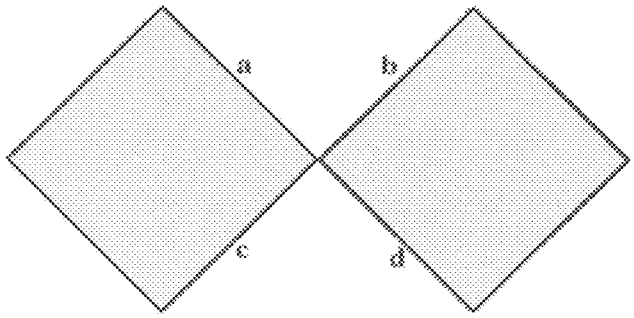
FIG. 9A depicts a flexible hinge element.

FIG. 9A depicts two puzzle objects joined along an edge with a hinge element formed from flexible material. This material could be, for example, in the form of thin flexible plastic that covers the surface of the cubes and is contiguous along an edge between the two cubes (e.g., as in the prior art Warhol puzzle). Alternately, thin material could be glued or bonded to, or tape could be adhered to, the surfaces labeled a and b, or the surfaces labeled c and d, or both. There are many standard materials and ways to adhere materials to form a flexible connection, and it is to be understood that embodiments of the present invention that incorporate such connections are not limited to particular implementations.

Figure 9B:
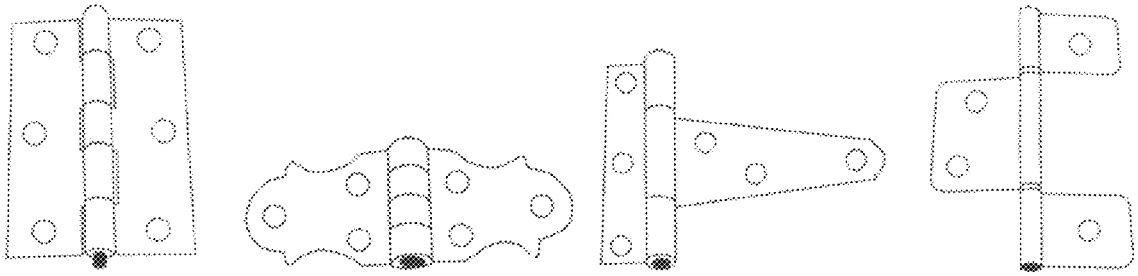
FIG. 9B depicts examples of interlocking hinge elements.
Figure 9C:
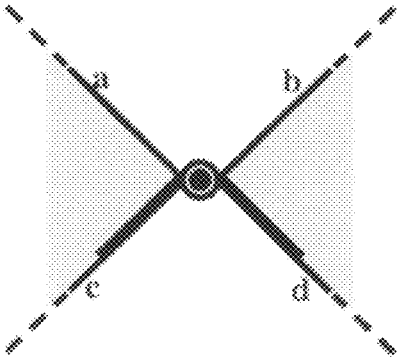
FIG. 9C depicts an interlocking hinge element that attaches in a recessed fashion.
Figure 9D:
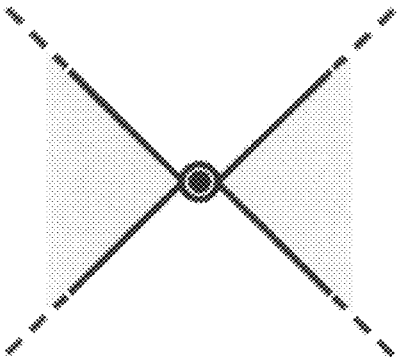
FIG. 9D depicts an interlocking hinge element that is integrated with the puzzle objects.

FIG. 9B depicts some examples of interlocking hinge elements where two pieces interlock via a central pin. Hinge elements of this type, and alike, have an advantage over the use of flexible material in that they can be more durable, and also more pleasurable to use. In some embodiments of the present invention a hinge element is attached to the surfaces; for example, referring to FIG. 9C, one half could be attached to one of surfaces a or c and the other half could be attached to one of surfaces b or d (in the example shown in FIG. 9C, the hinge element is attached to surfaces c and d). Also depicted in FIG. 9C is a method of attachment where the two halves of the hinge element are recessed into the surfaces so as to be flush with them. It is to be understood that methods for attaching hinge elements include, but are not limited to, screws, nails, rivets, glue, crimping, bonding, magnets, and welding. It is also to be understood that two hinge elements can share a common half in the event that they are both attached to the same surface. In other embodiments of the present invention, the halves of hinge elements may be integrated into the puzzle object as depicted in FIG. 9D; for example, a plastic mold could include the puzzle object and a portion of the hinge element as a single entity. It is to be understood that many variations of interlocking hinge design can be employed, in terms of both how hinge elements are integrated or attached to puzzle objects and how interlocking is effected, including via a pin, via a member functionally equivalent to a pin, via a member functionally equivalent to a pin that is integral with one of the hinge halves, via hooking, via magnetic edge joining, etc., and that the present invention is not limited to one particular design, size, shape, or material for interlocking hinge construction.

Figure 10A:
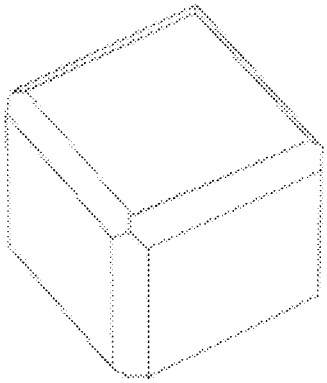
FIG. 10A depicts beveled edges.
Figure 10B:
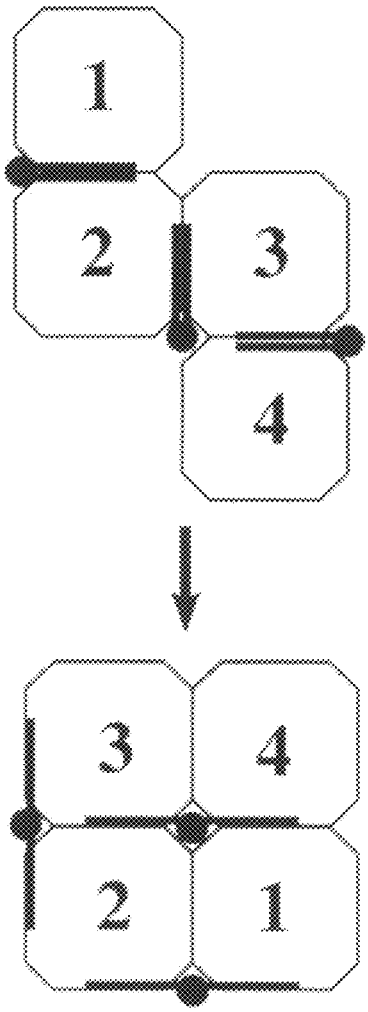
FIG. 10B depicts beveled edges with interlocking hinge elements.

Interlocking hinge elements are problematic for use in an arrangement such as depicted in FIG. 8, because the space occupied by the interlocking portion of the hinge element may adversely affect the ability of puzzle objects to properly fold. FIG. 10A depicts an aspect of the present invention to solve this problem by beveling the edges of puzzle objects (in this example, a cube) to a sufficient degree so as to accommodate the space required by the interlocking portion of the hinge elements. FIG. 10B depicts how puzzle objects can be manipulated by folding (FIG. 10B depicts hinge elements attached in a recessed fashion as shown in FIG. 9C; beveling may also be used to accommodate hinge elements integrated into the puzzle objects as depicted in FIG. 9D). Referring again to FIG. 8, flexible hinge elements could be used, or in the alternative, edges could be beveled to accommodate interlocking hinge elements. Interlocking hinge elements with beveled edges improves upon the use of flexible hinge elements of the prior art Warhol Cube.

Figure 11A:
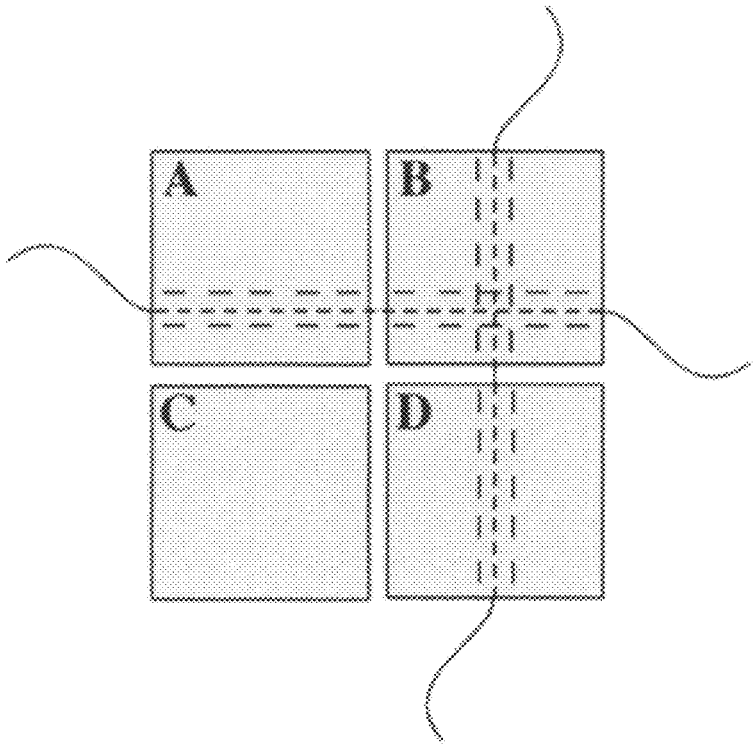
FIG. 11A depicts two rope elements threaded through an arrangement of puzzle objects.
Figure 11B:
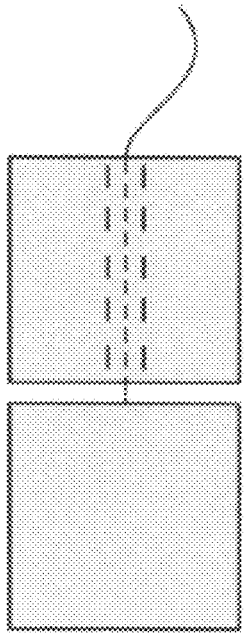
FIG. 11B depicts a rope element that has not been threaded through an arrangement of puzzle objects.

FIG. 11A shows one rope element threaded through an arrangement of 4 puzzle objects by passing horizontally through cubes A and B, and a second rope element threaded through the arrangement by passing vertically through B and D (in this example, C has no holes). FIG. 11B depicts a situation where a rope element passes through a puzzle object but not through the entire arrangement; in this case, the rope element is not threaded through the puzzle.

Figure 12A:
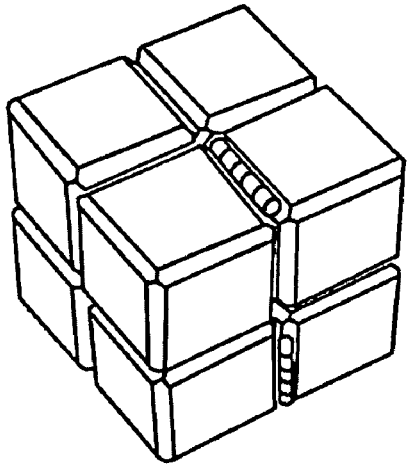
FIG. 12A, FIG. 12B, and FIG. 12C depict an embodiment of the present invention that employs a particular arrangement of interlocking hinge elements that join beveled cubes.
Figure 12B:
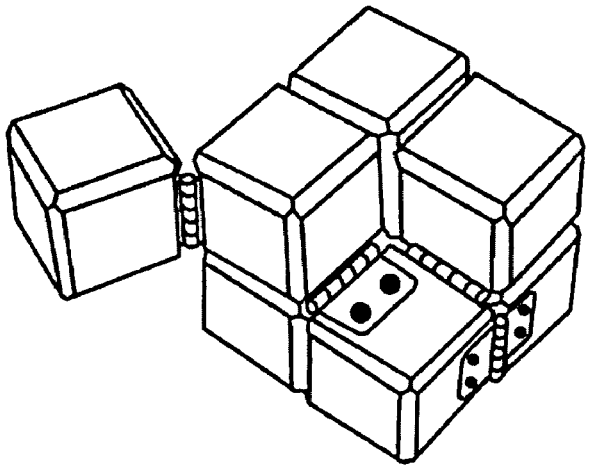
Figure 12C:
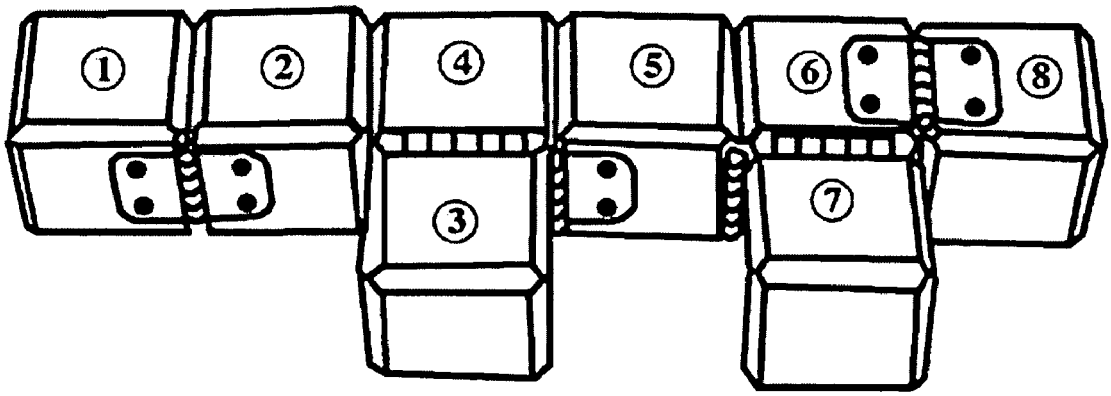

FIG. 12A, FIG. 12B, and FIG. 12C depict an embodiment of the present invention that has eight cubes with beveled edges that are joined by 7 hinge elements. FIG. 12A shows the cubes folded into a 2×2×2 arrangement. FIG. 12B shows a folding where one of the cubes can not be folded into place to form a 2×2×2 arrangement. To describe the placement of hinge elements we refer to FIG. 12C that shows the cubes unfolded:

Hinge 1 joins cube 2 to cube 1, on the front faces.

Hinge 2 joins cube 3 to cube 2, on the back face of 3 and the right face of 2.

Hinge 3 joins cube 4 to cube 3, on the top faces.

Hinge 4 joins cube 5 to cube 4, on the front faces.

Hinge 5 joins cube 6 to cube 5, on the left face of 6 and the right face of 5.

Hinge 6 joins cube 7 to cube 6, on the back face of 7 and the front face of 6.

Hinge 7 joins cube 8 to cube 6, on the top faces.

Figure 13A:
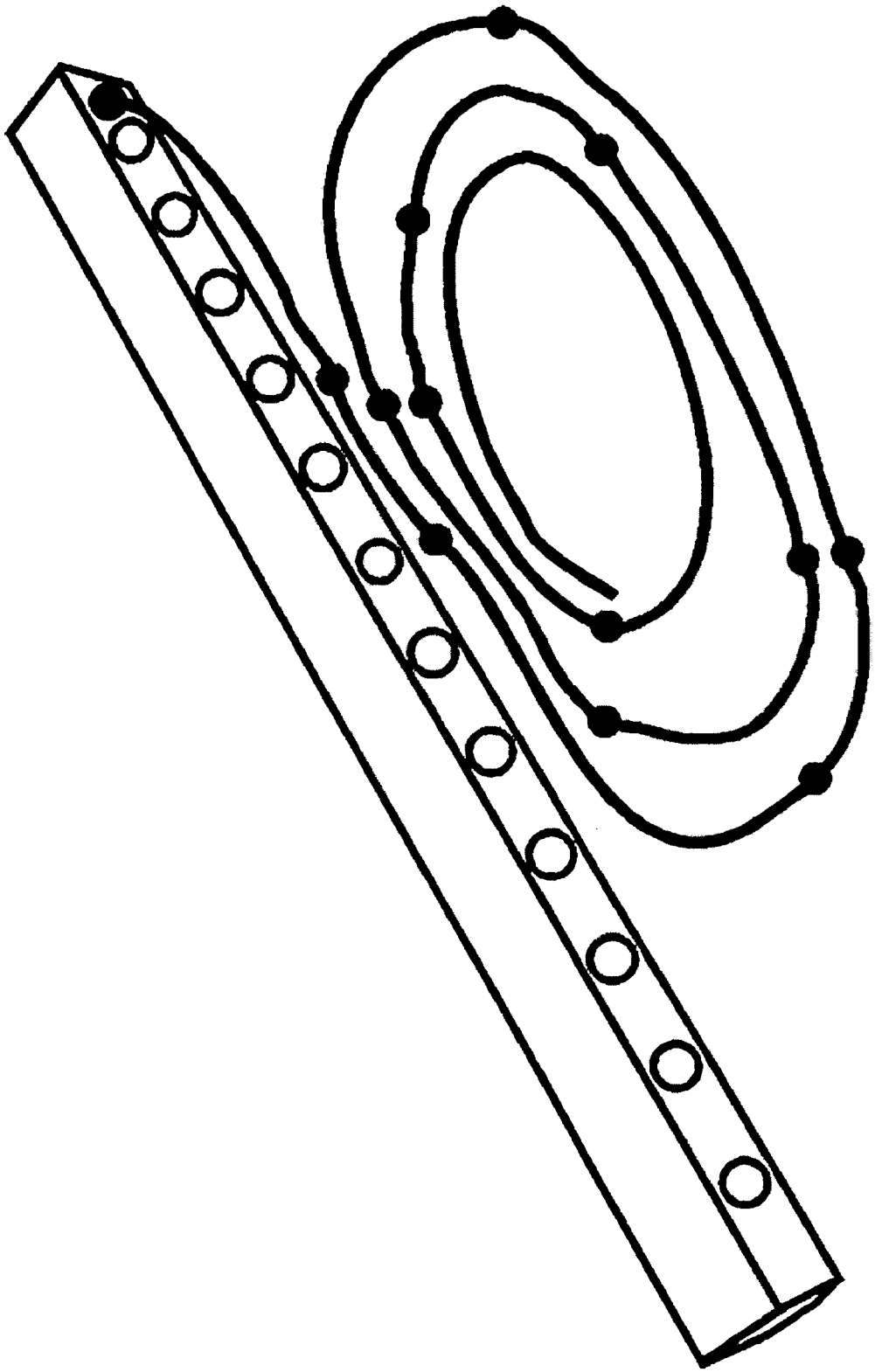
FIG. 13A, FIG. 13B, and FIG. 13C depict an embodiment of the present invention that employs a single object with holes through which a rope element with a particular placement of knot elements may be passed in such a way as to conceal the knot elements.
Figure 13B:
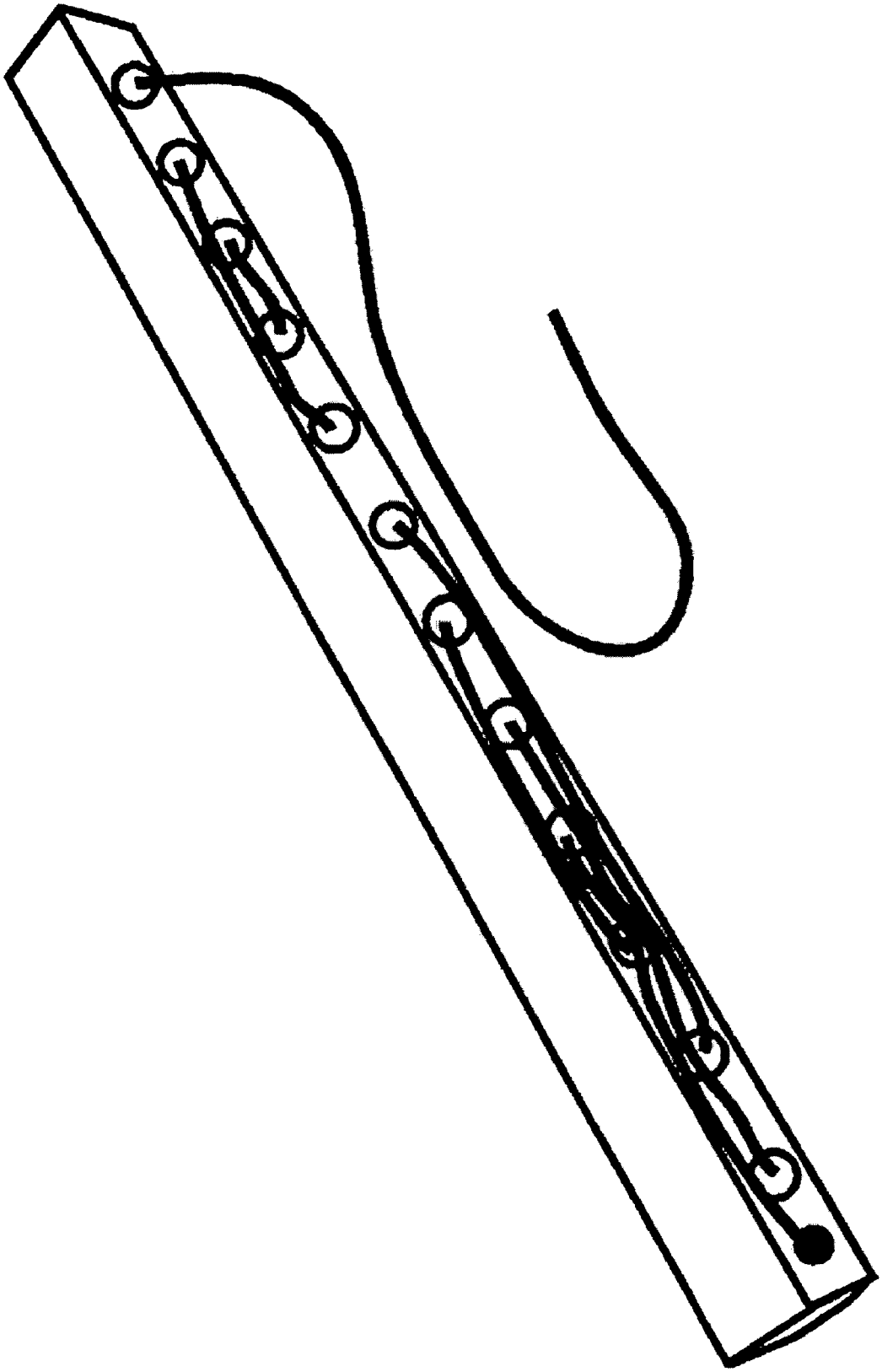
Figure 13C:
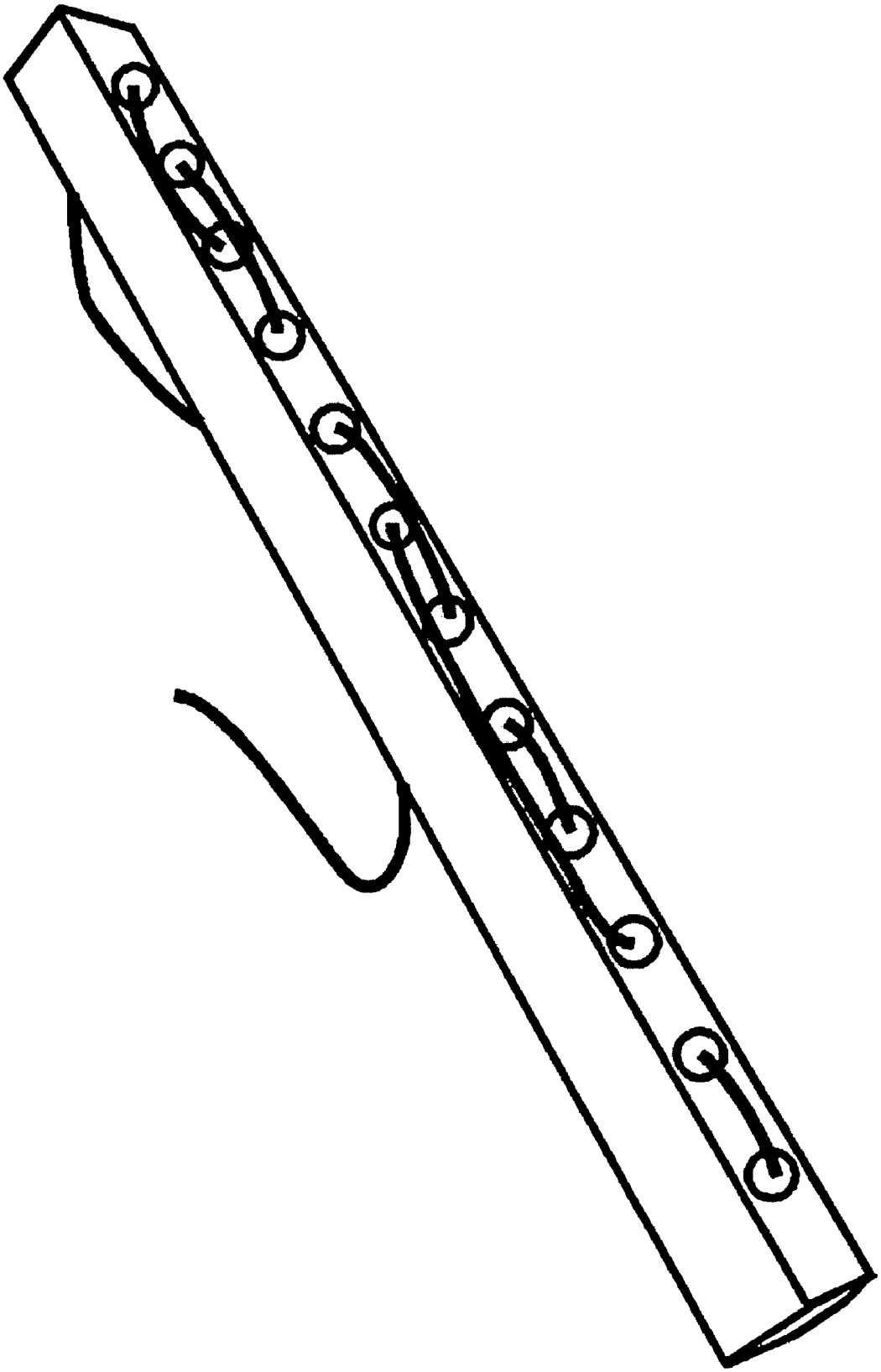

FIG. 13A, FIG. 13B, and FIG. 13C depict an embodiment of the present invention that has a single puzzle object (in this example, a bar) with 12 equally spaced holes and an attached rope element (in this example, nylon cord) with knot elements (in this example, knots). FIG. 13B and FIG. 13C show the two sides of the bar when the cord has been threaded through each of the holes, in the order 4, 5, 1, 2, 7, 3, 6, 8, 11, 9, 10, 12, so as to conceal the knots (where hole 1 is closest to where the rope is attached and hole 12 is furthest away).

One approach for the design of an apparatus according to the present invention can proceed as follows:

1. Make a collection of puzzle objects; a choice can be made as to whether flexible hinge elements will be used or interlocking hinge elements will be used (in which case edges can be beveled appropriately).
2. Position the puzzle objects in a particular arrangement.
3. Choose locations to place hinge elements. Note that if at some point, after choosing a number of locations for hinge elements, the puzzle objects do not have the connected property, then additional hinge elements can continue to be added until the puzzle objects have the connected property.
4. Using a drill or other appropriate tool, create tunnels that pass through the puzzle in a desired arrangement. Forming tunnels with the puzzle objects arranged in a desired arrangement can insure that the holes through puzzle objects line up properly; alternately, accurate measurements can be employed to place holes in each puzzle object individually.
5. Choose an order of tunnels through which to pass the rope element; each time the rope passes through the puzzle, temporarily pull it out of that hole to place a knot element; alternately, accurate measurements can be employed to place knot elements.

It is to be understood that although the above steps are an example of a simple approach to the design and construction of an apparatus according to an embodiment of the present invention, many known methods and technologies can be employed (including when manufacturing puzzles in quantity), and as already discussed, many variations of materials and design can be employed.

Figure 1:
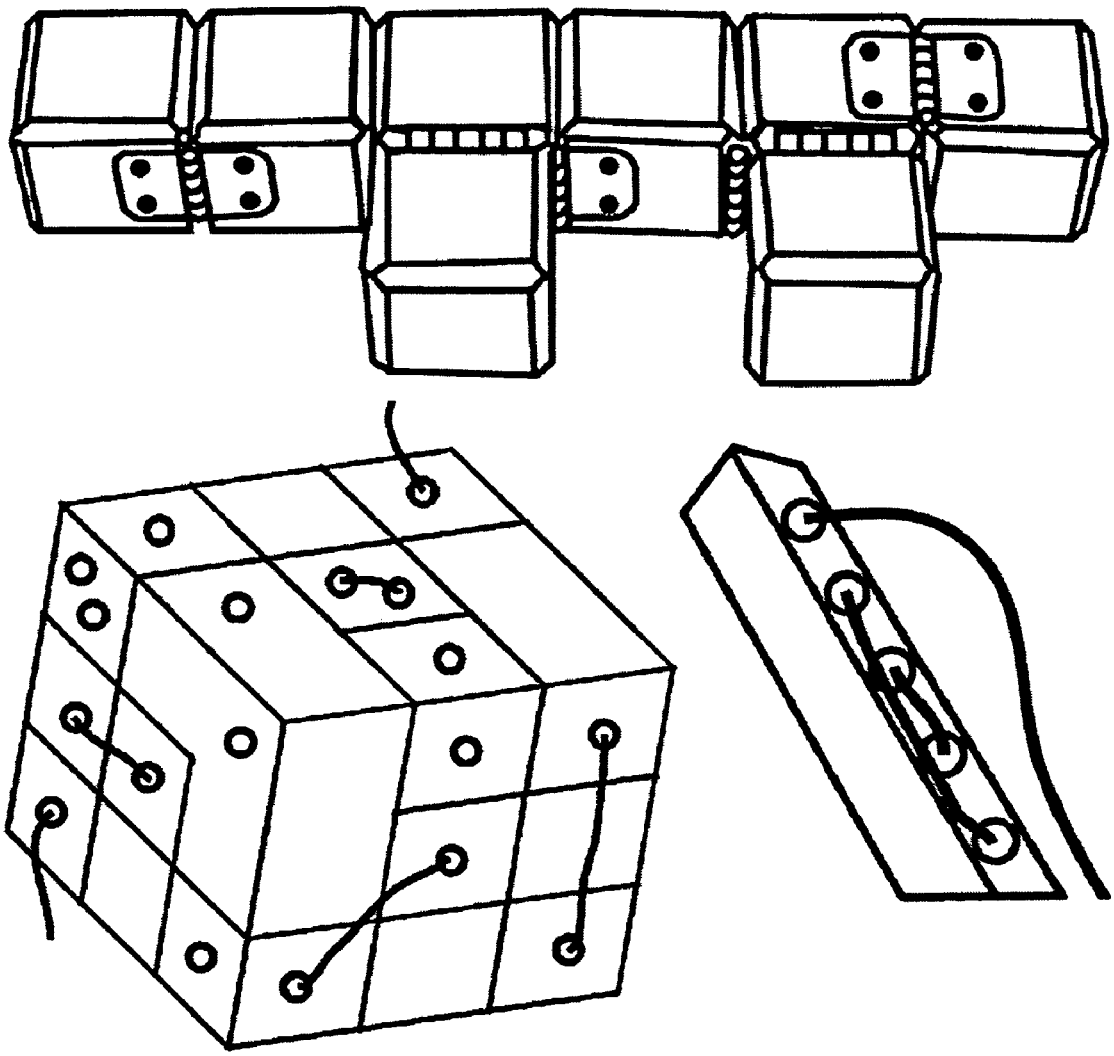
FIG. 1 shows examples of embodiments of the present invention.
Figure 2:
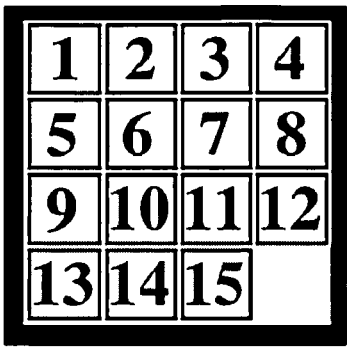
FIG. 2 (PRIOR ART)
FIG. 2 shows the prior art Fifteen Puzzle.
Figure 3:
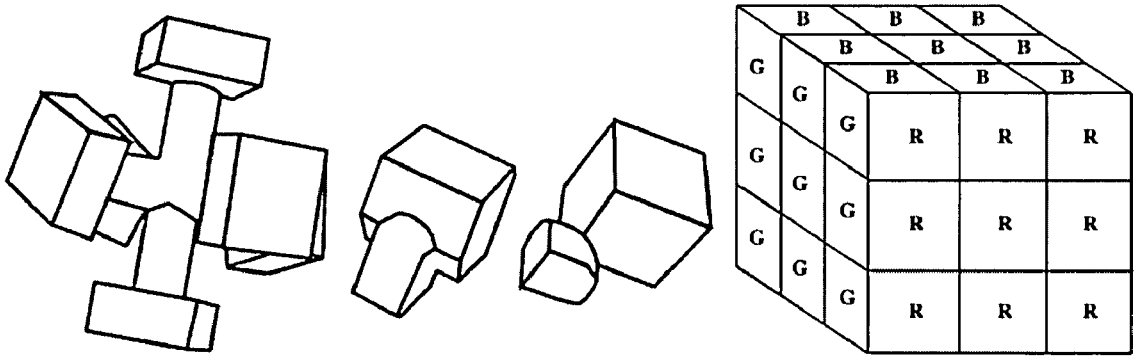
FIG. 3 (PRIOR ART)
FIG. 3 shows the prior art Rubik's Cube.
Figure 4:
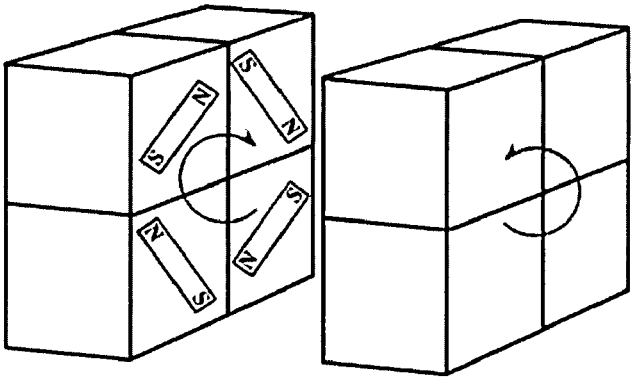
FIG. 4 (PRIOR ART)
FIG. 4 shows a the prior art puzzle described in the Nicholas patent.
Figure 5A:
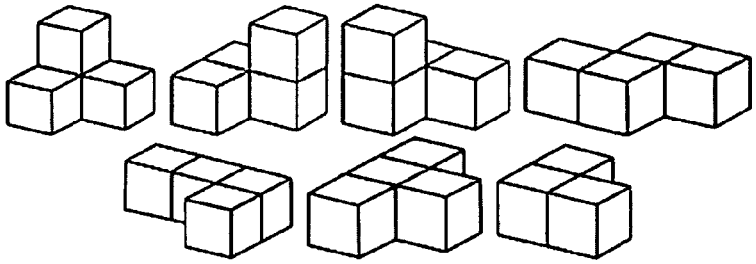
FIG. 5A (PRIOR ART)
FIG. 5A shows the pieces of the prior art Soma Cube (that can be assembled into a cube).
Figure 5B:
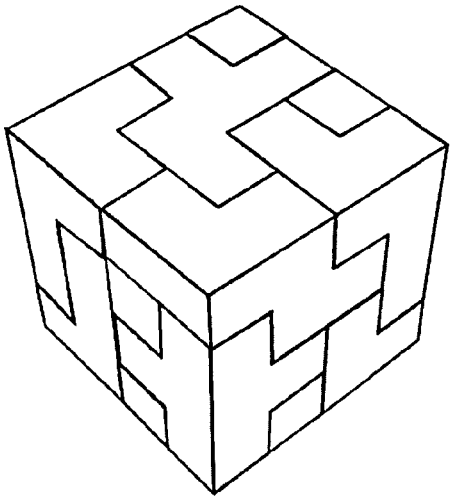
FIG. 5B (PRIOR ART)
FIG. 5B shows the prior art Bedlam Cube.
Figure 5C:
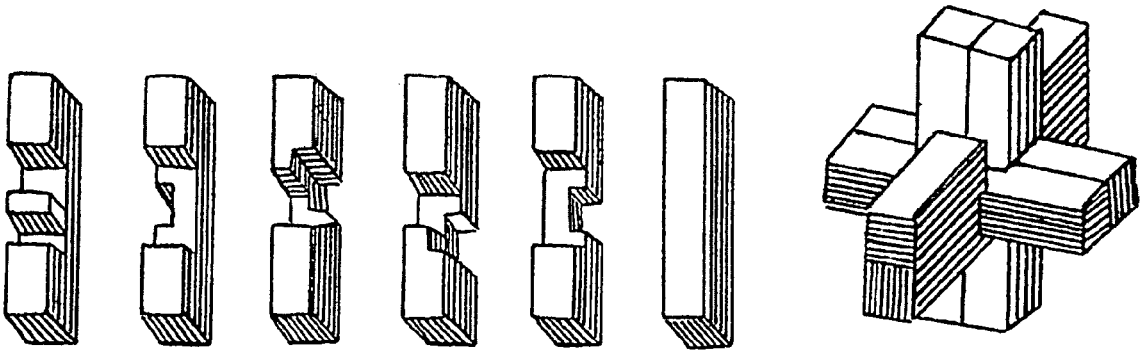
FIG. 5C (PRIOR ART)
FIG. 5C shows the prior art Yamato Burr (the pieces on the left and the assembled shape on the right).
Figure 6A:
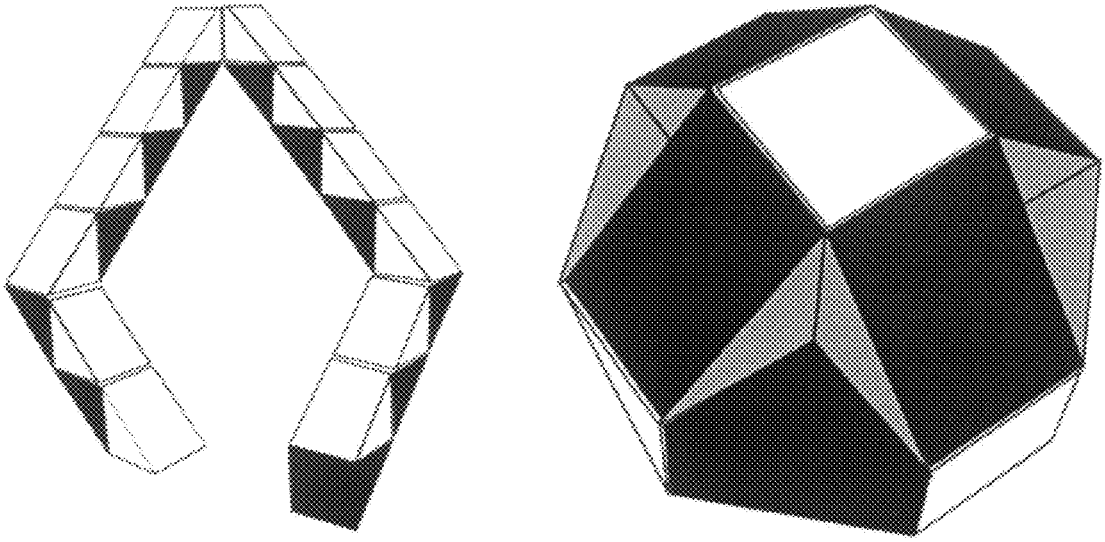
FIG. 6A (PRIOR ART)
FIG. 6A shows the prior art Rubik's Snake (unfolded on the left and folded into a diamond shape on the right).
Figure 6B:
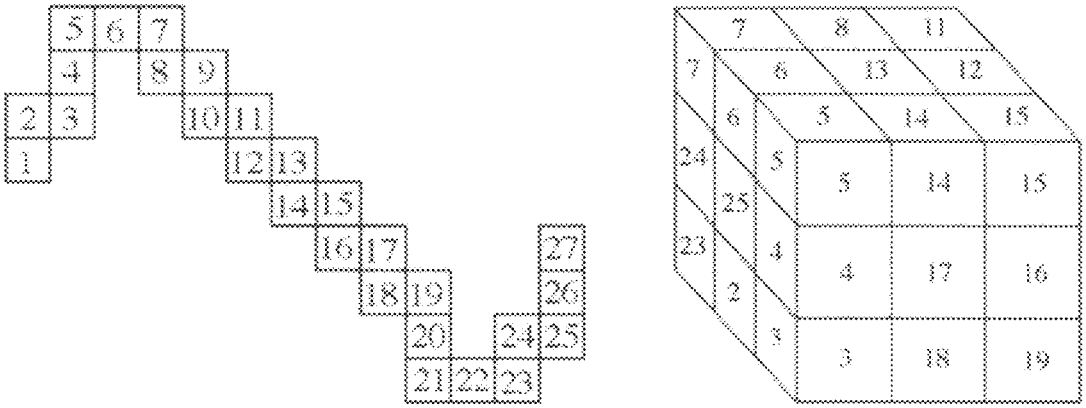
FIG. 6B (PRIOR ART)
FIG. 6B shows the prior art Kev's Cubes (unfolded on the left and folded into a cube on the right).
Figure 7:
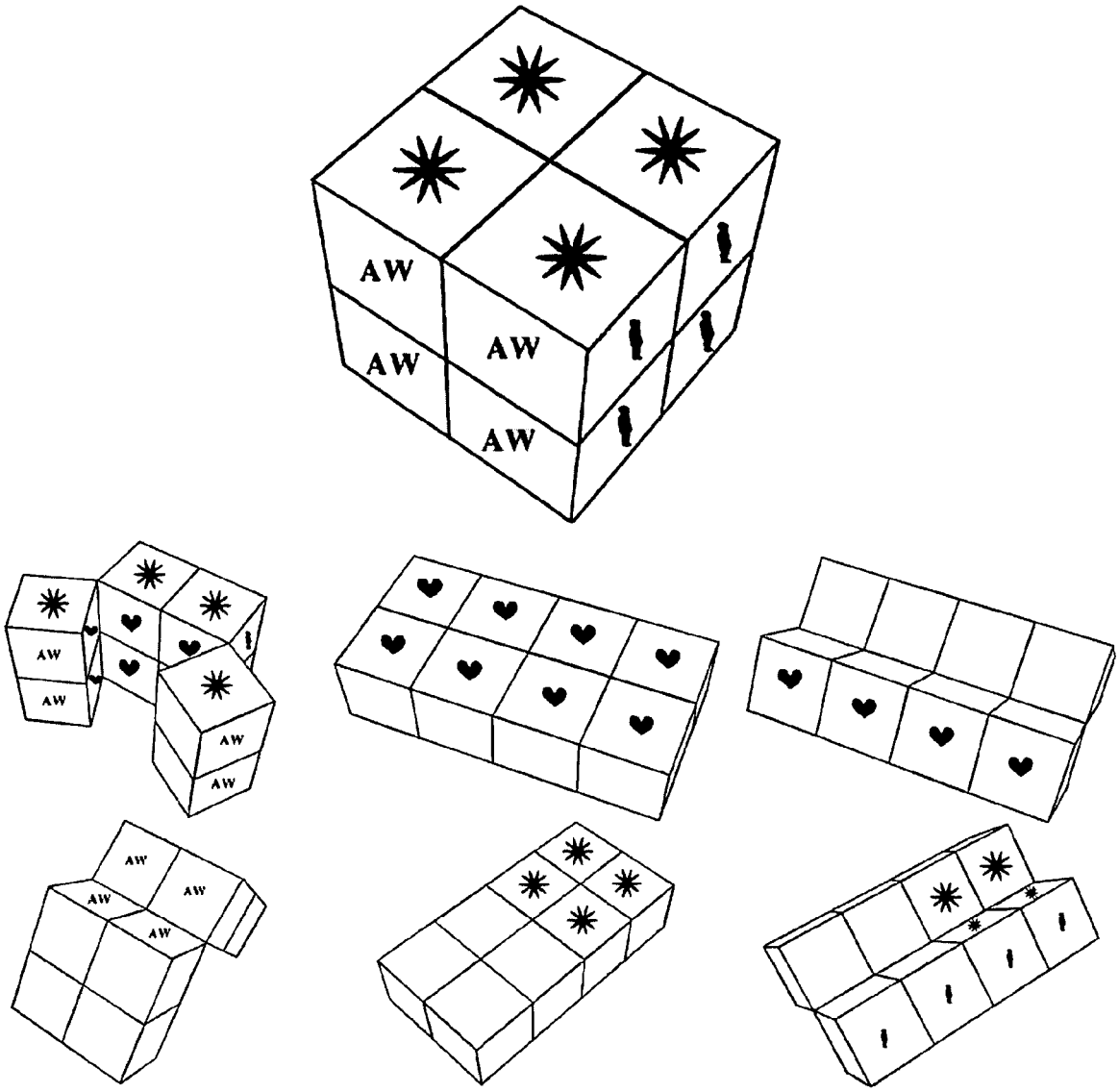
FIG. 7 (PRIOR ART)
FIG. 7 shows the prior art Warhol puzzle in its 2×2×2 arrangement, and also two ways of manipulating it from this 2×2×2 arrangement to 2×4×1 arrangements.

We now summarize some terms that are used herein and in the claims to describe the present invention:

puzzle object: An amusement apparatus, which we refer to as a puzzle, according to the present invention is formed from a number of puzzle objects. For example, in FIG. 12A the puzzle objects are cubes. Puzzle objects are not limited to any particular shape, and not limited to all be the same shape or size. In some embodiments of the present invention, puzzle objects are polyhedral shapes (where some or all of the edges may be beveled). However, curved and non-flat surfaces are also possible so long as for the case of more than one puzzle object there are edges where puzzle objects may be joined by hinge elements. It is to be understood that puzzle objects can be made from many different standard materials such as, but not limited to, wood, metal, ceramic, glass, cardboard, foam, and all types of plastics and similar materials.

hinge element: Puzzle objects may be joined by hinge elements. We distinguish between two types of hinge elements. Flexible hinge elements are of the type depicted in the prior art FIG. 7 (and also in FIG. 9A), where there is not a significant size to the connection; as already discussed, the present invention is not limited to a particular type of material or tape used to achieve a flexible connection. Interlocking hinge elements are of the type depicted in FIG. 9B, FIG. 9C, FIG. 9D, FIG. 10B, and alike, where two pieces interlock in some fashion, and where the interlocking portion has sufficient dimension so as to interfere with the folding of puzzle objects that do not have beveling; as already discussed, the present invention is not limited to a particular way interlocking hinge elements are integrated or attached to puzzle objects, or how interlocking is achieved.

connected property: A collection of N puzzle objects has the connected property if N=1 or N>1 and it is possible to number the objects from 1 to N so that for each i from 2 to N there is at least one hinge joining puzzle object i to a puzzle object numbered less than i.

object constraints: We use the term object constraints to refer to the specification of what constitutes a desirable arrangement of the puzzle objects (e.g., a required solution or visually pleasing arrangement). If the puzzle has only one puzzle object (e.g., as in FIG. 13A), object constraints are always considered to be specified, represented, and satisfied. For puzzles with more than one puzzle object, object constraints could be, but are not limited to, that the objects must be arranged to form a specific shape (e.g., a cube as is the case for the puzzle of FIG. 12A) or one of a set of shapes, or that the objects must be arranged so as to satisfy a particular color /graphics schemes on visible faces. The present invention is not limited to any particular way that object constraints are specified. In some embodiments of the present invention, specification of object constraints is in the form of directions that are associated with the puzzle. In other embodiments, color/graphics on the surface of the puzzle objects, together with natural and familiar shapes of the puzzle objects make desired arrangements apparent (e.g., as in the puzzle shown in FIG. 12A). Other embodiments are also possible, such as when tactile, visual, or audio feedback indicates when desirable arrangements of the puzzle objects have been achieved.

rope element: We use the term rope element to refer to any of a number of well known ways of achieving the functionality of rope using any of a variety of materials, including but not limited to rope, string, twine, filament, line, nylon line, gimp, gymp, lace, lanyard, ribbon, wire, braided wire, linked rods, and chain. A rope element may also include stiff portions (e.g., metal, ceramic, plastic, or wood, in the form of rod, tubing, sleeve, etc.). For example, FIG. 8 depicts a rope element with a single stiff element on one end; other embodiments of the present invention may have a plurality of stiff portions, while in yet other embodiments the rope element could be completely stiff (e.g., when the rope element is not attached to any puzzle object and there is a single tunnel in an arrangement that satisfies object constraints). In some embodiments of the present invention, one end of the rope element is attached to a puzzle object (e.g., FIG. 13A). In other embodiments, the rope element is not attached to any puzzle object and may optionally have a terminating ornament on one end (e.g., FIG. 8).

knot element: We use the term knot element to refer to way of marking portions of a rope element, including but not limited to knots, attached beads, attached ornaments, irregularities in the rope element, and the use of coloring/graphics on different portions of the rope element.

thread through: A rope element is said to thread through an arrangement of puzzle objects if it passes through one or more tunnels (formed by holes that align) in such a way as to go through the arrangement and not terminate inside it. That is, passing a rope element into a hole but not far enough to come out of the arrangement does not constitute threading. For example, FIG. 11A shows two rope elements, both of which are threaded through the arrangement of the four puzzle objects A, B, C, and D, whereas FIG. 11B shows a rope element that passes through one puzzle object, but is not threaded through the arrangement of two puzzle objects. The threading of a rope element through a sequence of tunnels may be specified by listing the first hole entered for each tunnel.

concealed knot: When a rope element with knot elements is threaded through an arrangement of puzzle objects, a knot element is said to be concealed if it is within a tunnel.

A number of considerations should be understood:

Hinge elements may differ within a given puzzle. For example, longer edges may use longer hinge elements or more than one hinge element along an edge.

Two puzzle objects may be joined by two or more hinge elements that are on different edges, causing those two puzzle objects to be held together (so they cannot be unfolded), and similarly three or more puzzle objects could be joined in a rigid configuration. Such configurations can be useful, for example, when it is desired to make a larger "virtual" puzzle object from several smaller ones.

For a rope element that has no knot elements, when the puzzle objects are arranged so as to satisfy the object constraints, there must be at least one way in which holes line up to form a tunnel all the way through the puzzle through which the rope element may be threaded. In the case that the rope element is not attached to the puzzle (e.g., as in FIG. 8), zero knot elements and one knot element are functionally equivalent (both circumstances only require the rope element to thread through the arrangement at least once). However, if one end of the rope element is attached to the puzzle, then it could be that it is possible to thread the rope element through more than one arrangement or through an arrangement in more than one way, but in only one way in one arrangement in such a way as to conceal the knot element.

With multiple puzzle objects connected by hinge elements where there is more than one way to fold them to satisfy the object constraints, the addition of holes and a rope element (possibly with knot elements) can limit the puzzle to a unique folding that satisfies the object constraints (because only one of the foldings may have the holes line up properly for the rope to be able to thread through).

Not all aspects of the present invention need to be incorporated into a single embodiment. For example, FIG. 12A uses puzzle objects with beveled edges and interlocking hinge elements but no rope elements, and FIG. 13A uses a rope element with knot elements but no hinge elements.

Another aspect of the present invention is a method for manipulating representations (physical, mechanical, electronic, etc.) of embodiments of a puzzle apparatus as described thus far. Instructions for such a method may be performed by many known computing architectures, including but not limited to computers, parallel computers, personal computers, PDA's, hand-held electronic devices, cell phones, intelligent terminals, intelligent video displays, file servers, cloud computing, custom chips, and embedded processors. Instructions may be embodied in a program storage device readable by machine, tangibly embodying a program of instructions executable by the machine to perform method steps. Instructions may be embodied by hardware or configuration of hardware such as a FPGA (Field-Programmable Gate Array). Instructions may also be transmitted electronically and retained in temporary or permanent storage. Digital electronic representation of physical objects has been well known in the art of computer graphics and computer aided design for many years. In the case of a plurality of puzzle objects having the connected property, well-known techniques can be used to test if a fold is possible (i.e., no two puzzle objects attempt to occupy the same space during or as a result of a specified fold). Specification of a fold can be achieved in a number of standard ways including, but not limited to, a textual description of the hinge element and desired angle, and pointing at graphical representations of hinge elements with a mouse, via a touch screen, or with virtual reality tools (e.g., such as a controller used by the well known Wii game system). Note that folding of hinge element representations can be specified and displayed in a visually continuous fashion, or, for example, by selecting choices of relevant hinge element positions (e.g., for a puzzle of the type of FIG. 12 where all puzzle objects are cubes, at most one 90 and one 180 degree fold with respect to at most two hinge elements are ever needed at a given point in time). Positions of knot elements on a rope element can be represented by storing their distances along the rope (e.g., the distance from one end of the rope element or the distances between successive knot elements), and it is understood that a variety of graphics can be used for an enjoyable display of a rope element with knot elements (worms with rings, snakes with spots, etc.). In the case of a single puzzle object with holes, the puzzle object can be assigned a fixed position in a standard representation of a three dimensional space (including, but not limited to, Cartesian coordinates or polar coordinates), coordinates can be computed for each end of each hole, and then tests for knot element locations (e.g., whether a knot element is inside a tunnel) can be performed based on the current sequence of tunnels through which the rope element has passed and the spacing of knot elements on the rope element. A similar representation can be used for multiple puzzle objects in a particular arrangement, where the coordinates of the hole ends are adjusted each time the arrangement is changed. Other standard representations are also possible, such as a well-known undirected graph data structure where explicit edges with associated lengths are used to represent the distances between tunnel ends. Specification of a threading of a rope element through a particular arrangement can be achieved in any of known techniques, including but not limited to a textual description of the sequence of tunnels to be visited, and pointing at graphical representations of tunnels with a mouse, via a touch screen, or with virtual reality tools. In some embodiments of the present invention for puzzles with a plurality of puzzle objects having the connected property, all folding is specified prior to any threading; in other embodiments, to the extent that no portion of a rope element interferes with a particular folding (would be caught between two puzzle objects during or as a result of the folding), foldings can be intermixed with threadings.

Although example embodiments have been described herein with reference to the accompanying figures, it is to be understood that the present invention is not limited to those examples, and that various other changes and modifications may be affected therein by one skilled in the art without departing from the scope or spirit of the invention. All such changes and modifications are intended to be included within the scope of the present invention as defined by the claims.

The invention claimed is:

1. A puzzle apparatus comprising:

a plurality of puzzle objects, wherein a plurality of the edges of said puzzle objects are beveled:

specification of object constraints for said puzzle objects;

a plurality of interlocking hinge elements, wherein each interlocking hinge element joins two of said puzzle objects, no two puzzle objects are joined by more than one hinge element, together the connections made by said interlocking hinge elements make said puzzle objects have a connected property, and the bevels of the edges of said puzzle objects are sufficient to accommodate said interlocking hinge elements;

one or more holes, wherein each hole passes through one of said puzzle objects;

a rope element, wherein said rope element can be threaded through one or more of the tunnels formed from said holes when said puzzle objects are in an arrangement that satisfies said object constraints.

2. An apparatus according to claim 1 wherein said rope element has one or more knot elements positioned such that said rope element can be threaded through one or more of the tunnels formed when said puzzle objects are in an arrangement that satisfies said object constraints, so as to conceal all of said knot elements.

3. A puzzle method comprising:

representing a plurality of puzzle objects;

representing object constraints for said puzzle objects;

representing a plurality of hinge elements in such a way that said represented puzzle objects have a connected property;

representing an initial configuration of said hinge elements;

receiving a sequence of hinge positions;

responding to each of said hinge positions, wherein said response is indicative of whether, starting in said initial configuration, said represented puzzle objects can be folded according to the thus far said received hinge positions and whether said object constraints have been satisfied;

representing a plurality of hole locations in said puzzle objects;

representing a rope element;

in the event that said represented puzzle objects can be folded according to the thus far said received hinge positions, providing a response indicative of whether said represented rope element representation can be threaded through some or all of the tunnels corresponding to said hole specifications.

4. A method according to claim 3 wherein:

said rope element representation comprises one or more knot element representations; and said threading conceals all of said knot element representations.

5. A puzzle method comprising:

representing a plurality of puzzle objects;

representing object constraints for said puzzle objects;

representing a plurality of hinge elements in such a way that said puzzle object representations have a connected property;

representing a plurality of hole locations in said puzzle object representations;

representing a rope element;

receiving a sequence of hole specifications;

responding to each of said hole specifications with a response indicative of whether, when said puzzle object representations are in an arrangement that is allowed by said hinge element representations and satisfies said object constraint representations, said rope element representation can be threaded through the sequence of tunnels corresponding to the thus far received said hole specifications.

6. A method according to claim 5 wherein said rope element representation comprises a plurality of knot element representations, and such that when said rope element representation is threaded according to said received sequence of hole specifications, all of said knot element representations are concealed.

7. A method according to claim 6 wherein there are 8 or more of said hole specifications.

8. A method according to claim 6 wherein there are 8 or more of said hole specifications and 8 or more of said knot representations.

* * * * *